US008760385B2

(12) United States Patent
Kwon et al.

(10) Patent No.: US 8,760,385 B2
(45) Date of Patent: Jun. 24, 2014

(54) LIQUID CRYSTAL DISPLAY DEVICE AND METHOD FOR LOCAL DIMMING DRIVING USING SPATIAL FILTER OF THE SAME

(75) Inventors: Kyung-Joon Kwon, Seoul (KR); Dong-Woo Kim, Seoul (KR); Hee-Won Ahn, Goyang-si (KR); Jung-Hwan Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 444 days.

(21) Appl. No.: 13/178,006

(22) Filed: Jul. 7, 2011

(65) Prior Publication Data

US 2012/0007896 A1 Jan. 12, 2012

(30) Foreign Application Priority Data

Jul. 9, 2010 (KR) ..... 10-2010-0066623

(51) Int. Cl.
*G09G 3/36* (2006.01)
*G09G 3/34* (2006.01)

(52) U.S. Cl.
CPC ..... *G09G 3/3426* (2013.01); *G09G 2320/0646* (2013.01)
USPC ..... 345/102

(58) Field of Classification Search
USPC ..... 345/87–104, 211–213
See application file for complete search history.

(56) References Cited

U.S. PATENT DOCUMENTS

2008/0031538 A1* 2/2008 Jiang et al. ..... 382/261
2008/0111784 A1* 5/2008 Tanaka et al. ..... 345/102
2009/0184917 A1* 7/2009 Park et al. ..... 345/102
2009/0201320 A1 8/2009 Damberg et al.
2010/0295767 A1* 11/2010 Lee et al. ..... 345/102
2011/0285681 A1* 11/2011 Kondoh et al. ..... 345/207
2011/0291919 A1* 12/2011 Kerofsky et al. ..... 345/102

FOREIGN PATENT DOCUMENTS

JP 2009-282451 12/2009
KR 1020090126337 A 12/2009
WO WO 2007063477 A2 6/2007

OTHER PUBLICATIONS

Office Action issued in corresponding Chinese Patent Application No. 201110190398.6, mailed Feb. 6, 2013.
Search Report issued in corresponding Chinese Patent Application No. 201110190398.6, dated Jan. 25, 2013.

* cited by examiner

*Primary Examiner* — Chanh Nguyen
*Assistant Examiner* — Sanghyuk Park
(74) *Attorney, Agent, or Firm* — Brinks Gilson & Lione

(57) ABSTRACT

A liquid crystal display device capable of improving a contrast ratio and of reducing a halo phenomenon with low power consumption and a method for local dimming driving the same are disclosed. A method for local dimming driving a liquid crystal display includes determining a local dimming value for each of light-emitting blocks based on analyzing input image data by the unit of light-emitting block provided in a backlight unit; determining a halo degree by analyzing a total light quantity of black pixels having black gradations in the input image data; adjusting the number of spatial filtering repetitions based on the determined halo degree; compensating the local dimming value by performing spatial filtering for the local dimming value an adjusted number of times; and controlling brightness of the backlight unit for each of the blocks by using the compensated local dimming value.

16 Claims, 5 Drawing Sheets

(A)

(B)

(C)

LIQUID CRYSTAL DISPLAY DEVICE AND METHOD FOR LOCAL DIMMING DRIVING USING SPATIAL FILTER OF THE SAME

Pursuant to 35 U.S.C. §119(a), this application claims the benefit of earlier filing date and right of priority to Korean Application 10-2010-0066623, filed on Jul. 9, 2010, the content of which is incorporated by reference herein in its entirety.

BACKGROUND

1. Field of the Invention

The present disclosure relates to a liquid crystal display device, more particularly, to a liquid crystal display device capable of improving a contrast ratio and of reducing a halo phenomenon with low power consumption, and a method for local dimming driving the same.

2. Discussion of the Related Art

Recently, flat panel display devices including liquid crystal display (LCD) devices, plasma display panels (PDP) and organic light emitting diodes (OLED) have been used extensively.

Such a LCD device includes a liquid crystal panel for displaying an image via pixel matrixes which uses electric and optical properties of liquid crystal having anisotropy with respect to refractivity and permittivity, a driving circuit for driving the liquid panel and a backlight unit for projecting a light toward the liquid crystal panel. Each of pixels provided in the liquid crystal display presents gradation by adjusting transmissivity of lights transmitted via the liquid crystal panel and a polarization plate from the backlight unit by variation of a liquid crystal arrangement direction based on a data signal.

Brightness of each pixel provided in the LCD device is determined by multiplication of light transmittance of the liquid based on brightness and data of the backlight unit. To improve a contrast ratio and to reduce power consumption, the LCD device analyzes an input image and adjusts a dimming value to control the brightness of the backlight. Also, the LCD uses backlight dimming which can compensate data. For example, a dimming value is decreased to decrease the backlight brightness decreased and data compensation increases brightness, according to a method for backlight dimming to reduce power consumption.

Recently, a light emitting diode (LED) has been used as light source the backlight unit, because the LED has an advantage of high brightness with low power consumption in comparison to a conventional lamp. It is possible to control brightness at each position in an LED backlight unit and the LED backlight unit may be driven in Local Dimming which controls brightness for each of divided light-emitting blocks. Local Dimming analyzes image data for each of light-emitting blocks and it determines a local dimming value, such that the brightness of the LED backlight may be controlled for each of the blocks based on the determined local dimming value and that the image data may be compensated. As a result, Local Dimming can improve a contrast ratio and reduce more power consumption.

However, Local Dimming has a disadvantage of halo which occurs because of combination of dimming difference among the light-emitting blocks and a dark screen. For example, if displaying according to Local Dimming an image having a bright (high) gradation object located in quite a dark (low) gradation background as shown in FIG. 1, dimming difference between bright blocks and dark blocks might generate halo in the dark block near the blocks displaying the bright object. Because of the halo, screen quality happens to deteriorate.

BRIEF SUMMARY

A method for local dimming driving a liquid crystal display includes determining a local dimming value for each of light-emitting blocks based on analyzing input image data by the unit of light-emitting block provided in a backlight unit; determining a halo degree by analyzing a total light quantity of black pixels having black gradations in the input image data; adjusting the number of spatial filtering repetitions based on the determined halo degree; compensating the local dimming value by performing spatial filtering for the local dimming value an adjusted number of times; and controlling brightness of the backlight unit for each of the blocks by using the compensated local dimming value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DETAILED DESCRIPTION OF THE DRAWINGS AND THE PRESENTLY PREFERRED EMBODIMENTS

Reference will now be made in detail to the specific embodiments of the present invention, examples of which are illustrated in the accompanying drawings. Wherever possible, the same reference numbers will be used throughout the drawings to refer to the same or like parts.

According to a local dimming driving method of the present disclosure, a spatial filter is used to reduce halo which is generated by dimming difference among light-emitting blocks with similar gradations. The spatial filter compensates a local dimming value of a corresponding light-emitting block based on local dimming values of neighboring light-emitting blocks with respect to the corresponding block. Because of that, dimming difference among the light-emitting blocks may be reduced in similar gradations.

For example, according to the spatial filtering method, a spatial filter having a predetermined window size is used and a filter factor is given to a local dimming value of each block located adjacent to the corresponding block. A large one of added values is selected as a local dimming value of the corresponding block, to be outputted. Because of that, each local dimming value of the light-emitting blocks may be compensated to have less difference from local dimming values of neighboring blocks. In addition, when the compensated local dimming value feeds back to repeat the spatial filtering, the dimming difference among the light-emitting blocks may be reduced more, to reduce halo more.

Figure 1:
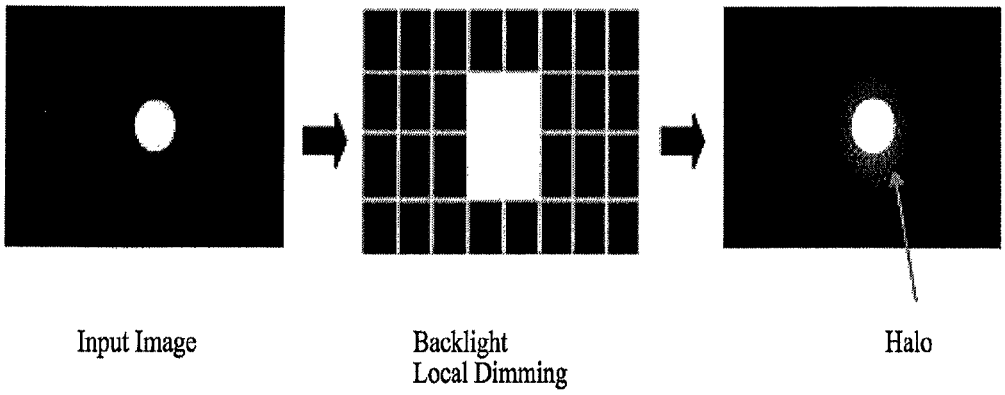
FIG. 1 PRIOR ART
FIG. 1 is a diagram illustrating a halo phenomenon generated by dimming difference between black gradation blocks according to a conventional local dimming driving method.
Figure 2:
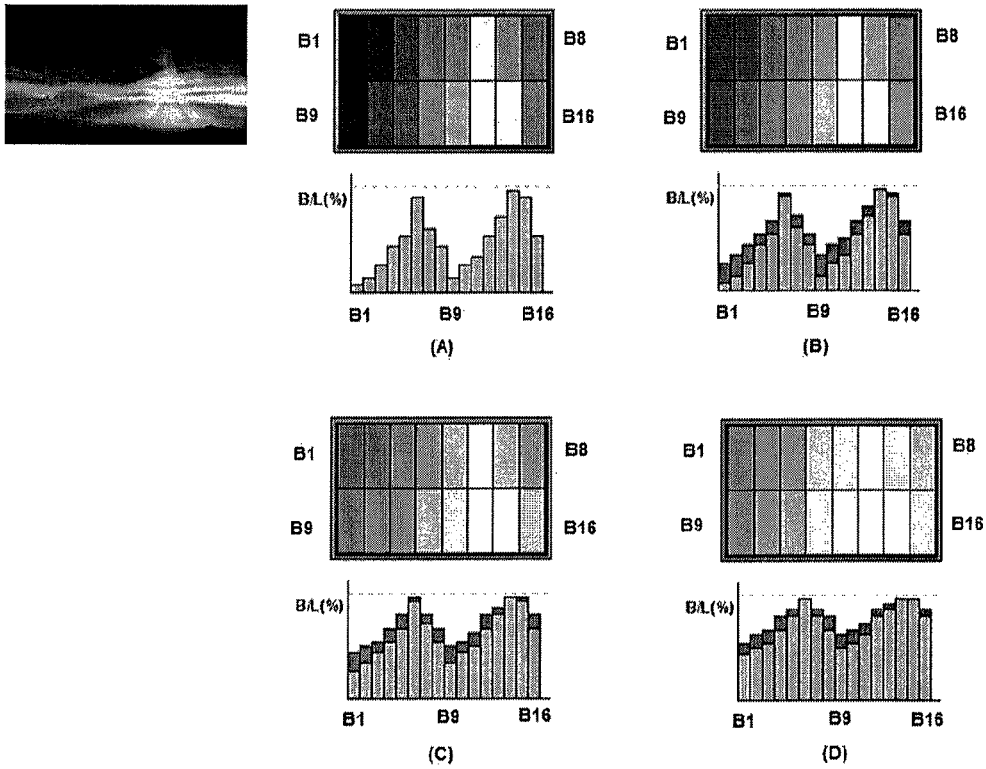
FIG. 2 is a diagram illustrating a changing process of local dimming values and brightness for light-emitting blocks based on repetition of spatial filtering which applies to the present invention, step by step.

FIG. 2 is a diagram illustrating a changing process of both the local dimming values and brightness of the light-emitting blocks based on the repetition of the spatial filtering applied to the present invention, step by step.

In reference to FIG. 2, an LED backlight unit of the liquid crystal display device according to the present invention is divided into a plurality of light-emitting blocks (B1~B16) and backlight brightness for each block is controlled based on a local dimming value (BL %) determined by block image analysis. FIG. 2 (A) shows the local dimming value (BL %) for each block determined based on analysis of an image shown in FIG. 2 and light-emitting brightness controlled based on the determined local dimming values. When the spatial filtering is performed once, the local dimming values (BL %) for the blocks may increase entirely and dimming difference among the blocks may be reduced as shown in (A) of FIG. 2, such that brightness difference among the light-emitting blocks may be reduced. when the spatial filtering is performed two or three times, the local dimming values (BL %) of the blocks may increase as shown in (C) and (D) of FIG. 2 such that brightness difference among the blocks may be reduced more.

When the spatial filtering is repeated as mentioned above, the dimming difference among the light-emitting blocks may be reduced more remarkably and the halo generated by combination between the dimming difference and a dark screen may be reduced effectively and advantageously. However, as the number of the spatial filtering repetition performances is increasing, the local dimming values (BL %) may be heightened gradually, to increase power consumption and to decrease a contrast ratio. Because of that, when the number of the spatial filtering repetitions is fixed a basis of an image with severe halo, unnecessary spatial filtering may be repeated in images without halo, to increase power consumption and to reduce the contrast ratio. As a result, the local dimming effect may deteriorate.

To solve the problem, the present invention adjusts the number of the spatial filtering repetitions adaptively based on image analysis. Halo may be reduced by the spatial filtering repetition performed in images which will generate halo and the number of the spatial filtering repetitions may be reduced in images which will not generate halo. Because of that, power consumption may be decreased and the contrast ratio may be increased. This is an object of the local dimming method according to the present invention.

According to the present invention, an input image is analyzed and the number of the spatial filtering repetitions is adjusted according to a halo degree of halo which will be generated during the local dimming. For that, the present invention allows a halo generation degree, in other words, a halo size to be quantifiable and it adjusts the number of the spatial filtering repetitions based on the halo size. As a result, the local dimming driving method according to the present invention may be categorized into a halo size quantifying method for quantifying the halo size based on analysis of an input image and a spatial filtering repetition adjusting method for adjusting the number of the spatial filtering repetitions based on the quantified halo size.

First of all, the halo size quantifying method with respect to the input image will be described. The halo phenomenon may be defined as one of similar gradations looking different as different brightness in a dark low gradation screen, because of brightness difference among light-emitting blocks of the backlight generated by local dimming. As a result, the quantity of lights (light leakage quantity) reaching pixels having dark low gradations from each of the light-emitting blocks of the backlight in a single screen (frame) may be analyzed and the halo size of the present screen may be quantified based on the analysis.

According to properties of the halo, the halo is generated in low gradation brightness near black (0~5 gradation, hereinafter, black gradations) and backlight brightness difference among black gradations is represented as halo. As the brightness difference among the black gradations is increased gradually, the strong halo phenomenon may be generated. The halo size may be quantified as shown in following Mathematical Equation 1 based on those halo properties, to be defined as 'Halo Indicator (LH)'.

$$LH = \alpha DB, \qquad \text{[Mathematical Equation 1]}$$

$$DB = \frac{\Sigma|MB - LB|}{NB}$$

In Mathematical Equation 1, 'LH' refers to the halo indicator and 'α' refers to a scaling factor and 'DB' refers to an average of brightness (light quantity) difference among black pixels in a single frame. 'LB' refers to the total quantity of lights reaching each of the black pixels from each of the light-emitting blocks and 'MB' refers to the number of black pixels located in the single frame. To calculate the average (DB) of the light quantity difference among the black pixels, difference values between the average (MB) of the total light quantity for the black pixels and the total light quantity (LB) of each black pixel are added and the added values are divided by the number of the black pixels as shown in Mathematic Equation 1. As the brightness difference among the black pixels is increasing, the average (DB) of the light difference among the black pixels may be increasing. The size of the halo indicator (LH) is in proportion to the average (DB) of the brightness difference values among the black pixels.

After quantifying the halo degree of the input image to be the halo indicator (LH), the local dimming driving method according to the present invention adjusts the number of the spatial filtering repetitions based on size of the halo indicator (LH).

Figure 3:
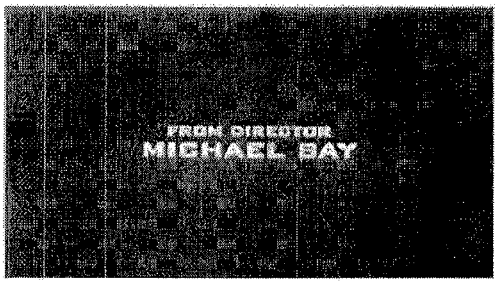
FIG. 3 is a diagram illustrating images having different halo sizes, respectively, according to an embodiment of a method for local-dimming driving of a liquid crystal display device according to the present invention.
Figure 3:
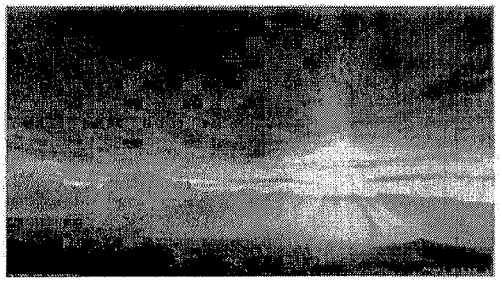
Figure 3:
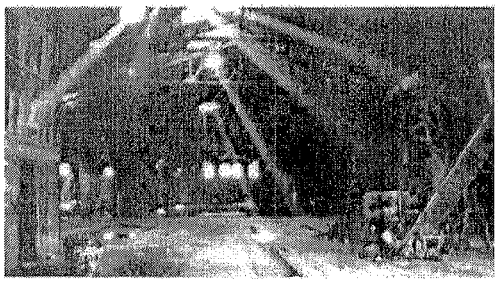

For example, in case of a screen having severe halo as shown in FIG. 3 (A), the size of the halo indicator is getting larger and the number of the spatial filtering repetitions is adjusted to be three times or more. Because of that, the halo reduction effect may be improved. In case of a screen having little halo as shown in FIG. 3 (C), the size of the halo indicator is getting smaller and the number of the spatial filtering repetition is adjusted to be one time. Because of that, the local dimming effect of reduced power consumption with an increased contrast ratio may be maintained. In case of a screen having middle level halo as shown in FIG. 3 (B), the size of the halo indicator has a middle value and the number of the spatial filtering repetitions is adjusted to be middle, for example, two times or three times. Because of that, the local dimming effect may be improved with reducing the halo properly, compared with the case of the severe halo.

Furthermore, the local dimming driving method according to the present invention may adjust the factor of the spatial filter as well as the number of the spatial filtering repetitions based on the size of the halo indicator (LH). For example, the size of the halo indicator (LH) is divided into a plurality of ranges and the number of the spatial filtering repetitions is adjusted based on a range of the halo indicator (LH). Each range of the halo indicators (LH) is divided more specifically and the spatial filter factor may be adjustable accordingly. because of that, in case of adjusting the number of the spatial filtering repetitions and the factor of the spatial filter, the local dimming values may be adjustable more specifically, compared with the case of adjusting only the number of the spatial filtering repetitions, such that the local dimming values may be compensated more dynamically.

Figure 4:
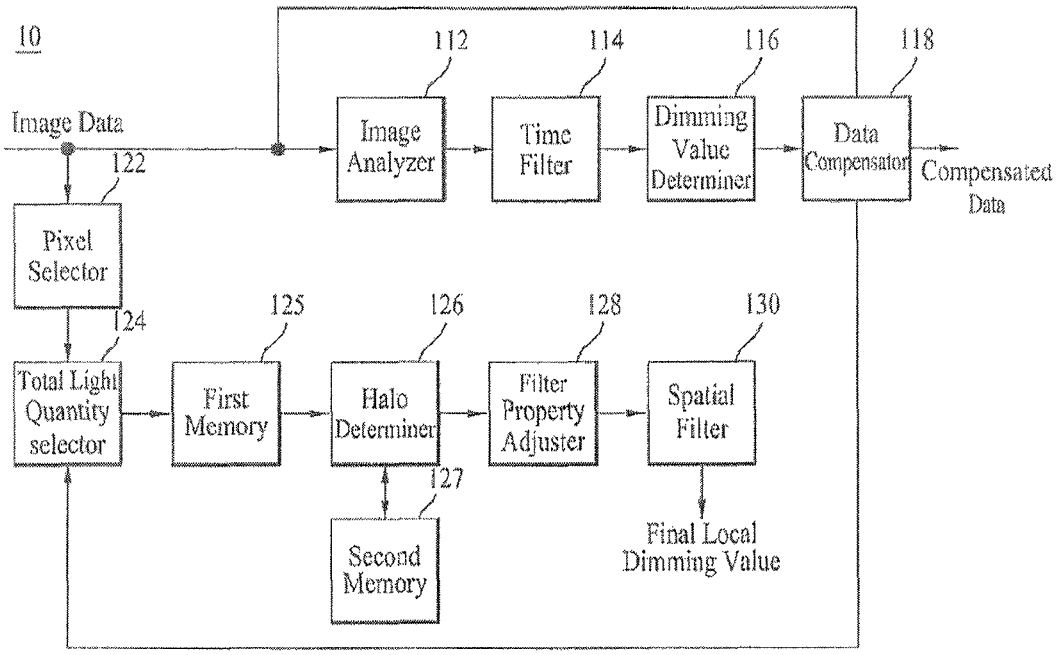
FIG. 4 is a block view illustrating a local dimming driver of the liquid crystal display device according to an embodiment of the present invention.
Figure 5:
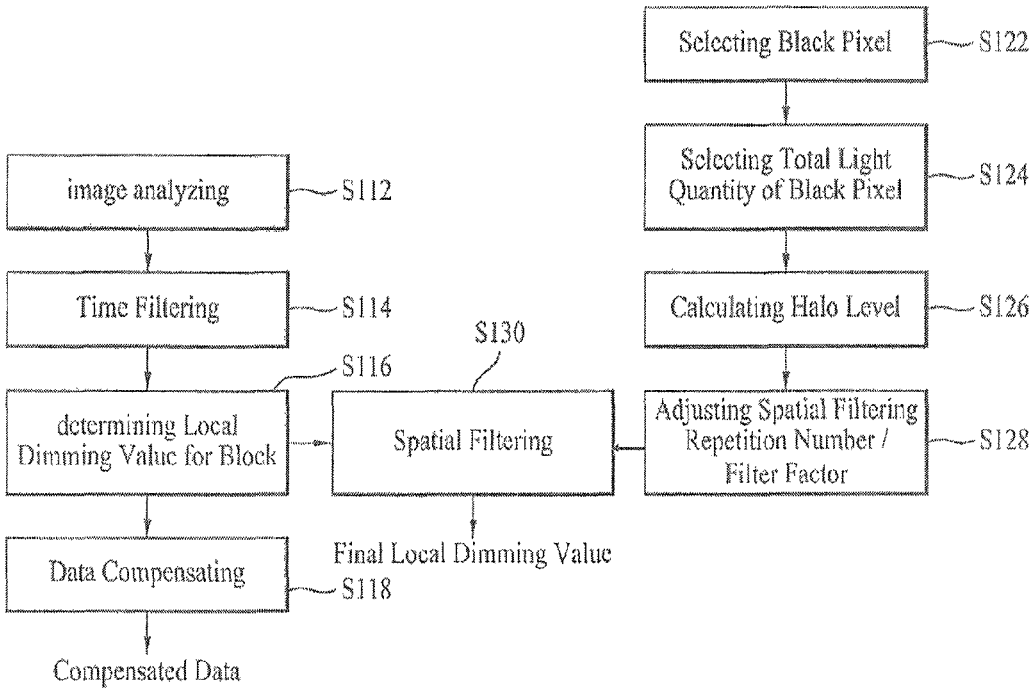
FIG. 5 is a flow chart illustrating a method for local-dimming driving a liquid crystal display device according to an embodiment of the present invention.

FIG. 4 is a circuit block view illustrating a local dimming driver provided in the liquid crystal display device according to the present invention. FIG. 5 is a flow chart illustrating the local dimming driving method according to the present invention step by step.

The local dimming driver 10 shown in FIG. 4 includes an image analyzer 112, a time filter 114, a dimming determiner 116, a data compensator 118, a pixel selector 112, a total light quantity selector 124, a first memory 125, a halo determiner 126, a second memory 127, a filter property adjuster 128 and a spatial filter 130. As follows, a method for driving the local dimming driver 10 will be described in reference to FIGS. 4 and 5.

The image analyzer 112 analyzes input image data by a block unit corresponding to each of the light-emitting blocks of the LED backlight unit and it detects an average for each block. After that, the image analyzer 112 outputs the average to the dimming value determiner 12 (S112). Specifically, the image analyzer 112 detects a maximum value for each pixel from the input image data and it divides the maximum value for each pixel into block units, to add and calculate an average of the added value. After that, the image analyzer 112 detects a data average for each block and it outputs the data average to the time filter 114.

To prevent the average for each block output from the image analyzer 112 from changing drastically, the time filter 114 filters a data average for each block in the present frame temporally, to compensate the average for each block in the present frame based on the average for each block in a former frame (S114). For example, the time filter 114 outputs averages for blocks in the present frame and averages for blocks temporally leveled for predetermined frames by calculating and leveling averages of for blocks in former frames, such that the average values for the blocks in the present frame may be compensated. At this time, the time filter 114 gives a relatively higher weight to a frame temporally closer to the present frame, to level the averages for the blocks temporally. Because of that, the average for each block may be prevented from changing drastically by noise and the like and flicker may be then prevented.

The dimming value determiner 116 may determine a local dimming value for each block corresponding to the filtered average for each block by the time filter 114 temporally and it may output the determined local dimming value to the data compensator 118 (S116). The dimming value determiner 116 selects and outputs a local dimming value for each block corresponding to the average for each block by using a preset lookup table.

The data compensator 118 calculates a gain value for each pixel based on the local dimming value for each block outputted from the dimming value determiner 116 and it compensates input data based on the calculated gain value for each block, to output to a timing controller (S118). For the gain value for each block, a light emitting property of each block provided in the LED backlight unit, in other words, a light profile generated by measuring the light quantity according to the distance is stored in a memory mounted in the data compensator 118 in advance. The data compensator 118 calculates a first total light quantity for lights for each pixel which reach each pixel from the blocks based on the light profile of each block, when the LED backlight unit has the maximum brightness. The data compensator 118 calculates a second total light quantity of lights for each pixel, which reach each pixel from the light emitting blocks having brightness adjusted according to the local dimming method, based on the local dimming value determined by the image analysis and the light profile of each light-emitting block. The data compensator 118 calculates a gain value based on a ratio of the second total quantity to the first total quantity and after that, it multiplies the calculated gain value to input data to compensate the input data and to output the compensated input data to the timing controller. As a result, brightness decreased to be the local dimming of the LED backlight unit may be compensated based on the data. Also, the data compensator 118 outputs the second total light quantity for each pixel of lights reaching each pixel from the blocks to the total light quantity selector 124 as total quantity for each pixel, when local dimming.

The pixel selector 122 selects and outputs a black pixel having low gradations (0~5 gradations) adjacent to black from the input image data (S122).

The total light quantity selector 124 inputs data of the total light quantity for each pixel outputted from the data compensator 118 and it selects total light quantity data corresponding to the black pixel selected from the pixel selector 122, to store the selected data in the memory 125 (S124). At this time, the total light quantity selector 124 stores "0" as total light quantity data of pixels not selected as black pixels by the pixel selector 122. The first memory 125 stores total light quantity data supplied from the total light quantity selector 124 by frame units, and it outputs the frame-unit stored data to the halo determiner 126.

The halo determiner 126 analyzes the total light quantity data for the black pixel frame-unit-stored in the first memory 125, to calculate a halo indicator (LH) for an input image of a single frame. After calculating the halo indicator, the halo determiner 126 determines and outputs a halo level based on a size range of the halo indicator (LH).

Specifically, the halo determiner 126 adds the total light quantities for the black pixels stored in the first memory 125 by the frame units and it divides the added total light quantities by the number of the black pixels (NB), to get a first average (MB) of the total light quantities of the black pixels. After that, a difference between the first average (MB) of the total quantities of the black pixels and the total light quantity for each black pixel is calculated based on Mathematical Equation 1 mentioned above. The calculated total quantity differences among the black pixels are added by the frame units. Then, the added value is divided by the number of the black pixels (NB) to be leveled, such that a second average (DB) of the total light quantity differences among the black pixels may be calculated by the frame units. A preset scaling factor (a) is multiplied to the second average (DB) of the total light quantities of the black pixels, to calculate a halo indicator (LH). The calculated halo indicator (LH) is stored in the second memory 127. The size of the halo indicator (LH) is increasing in proportion to the second average (DB) of the total light quantities of the black pixels.

The halo determiner 126 categorizes the size of the halo indicator (LH) into a plurality of ranges and it sets a plurality of halo levels, for example, 0~5 levels corresponding to the plurality of the ranges. The halo determiner 126 selects and outputs a halo level corresponding to a range the calculated halo indicator (LH) belongs to. At this time, to prevent the halo level from being varied by variation of the halo indicator (LH) generated because of noise elements, a halo indicator detected from the former frame is used to detect a halo level of the present frame. For example, the halo determiner 126 compares the size of the halo indicator of the former frame with the size of the halo indicator of the present frame outputted from the second memory 127. When difference between the halo indicator size of the former frame and the halo indicator size of the present frame is within a preset threshold value (TH), it is determined that the halo indicator variation is generated because of noise elements. As a result, the halo determiner 126 selects a halo level of the present frame based on the halo indicator of the former frame instead of the halo indicator of the present frame, and the variation of the halo level generated by the variation of the halo indicator happened because of noise elements may be prevented. Here, halo indicators between neighboring frames may be increased or decreased. At this time, a first threshold value for a range of increasing halo indicators is set different from a second threshold value for a range of decreasing halo indicators, such that the noise elements may be removed more effectively. The halo determiner 126 stores the halo indicator (LH) calculated from the present frame in the second memory 127 and it uses the halo indicator in the next frame as halo indicator (LH) of the former frame.

The filter property adjustor 128 adjusts the number of the spatial filtering repetitions performed by the spatial filter 13 based on the halo level outputted from the halo determiner 126 (S128). The filter property adjuster 128 increases the number of the spatial filtering repetitions as the halo level is getting larger and it decreases the number as the halo level is getting smaller. In addition, the filter property adjuster 128 may adjust a filter factor of the spatial filter 130 as well as the number of the spatial filtering repetitions based on the halo level. For example, the filter property adjusting part 128 adjusts the number of the filtering repetitions based on each level range including the plurality of the halo levels and it adjusts the filter factor in a corresponding range of halo levels based on the halo level. As the halo level is getting larger, the number of the spatial filtering repetitions and the filter factor may be increasing. As the halo level is getting smaller, the number of the spatial filtering repetitions and the filter factor may be decreasing.

The spatial filter 130 performs spatial filtering based on the number of the spatial filtering repetitions adjusted based on the halo level by the filter property adjuster 128, or based on the number of the spatial filtering repetitions and the filter factor. The spatial filter 130 compensates the local dimming values for blocks outputted from the dimming value determiner 116 and it outputs the compensated local dimming values to the backlight driver (S130). In case of a screen having a large halo level as shown in FIG. 3 (A), the spatial filtering is performed a predetermined number of times, which is adjusted by the spatial filter 130, for example, three times or more and the local dimming values are compensated to reduce the halo phenomenon. When the spatial filtering is repeated based on the filter factor increasingly adjusted by the filter property adjuster 128, the halo phenomenon may be reduced more. In case of a screen having a small halo level as shown in FIG. 3 (C), the spatial filter 130 performs spatial filtering for the local dimming value a predetermined number of times, which is adjusted by the filter property adjuster 128, for example, one time. Because of that, the local dimming effect of reduced power consumption with an increased contrast ratio may be maintained. In case of a screen having a middle halo level as shown in FIG. 3 (B), the spatial filter 130 performs the spatial filtering a predetermined number of times, which is adjusted by the filter property adjuster 128, for example, two or three times and it compensates the local dimming value. Because of that, the halo may be reduced and the local dimming effect may be improved simultaneously, compared with the case of (A) having severe halo. At this time, when the spatial filtering is repeated based on the filter factor adjusted by the filter property adjuster 128, the local dimming value may be adjusted more minutely. Because of that, the halo may be reduced more or the local dimming effect may be improved more, even with the same number of the spatial filtering repetitions.

Moreover, the local dimming driver 10 according to the present invention may further include a multiplier (not shown) configured to multiply the local dimming value outputted from the spatial filter 130 to a global dimming value inputted from an outside based on a user's brightness adjustment, to compensate the local dimming value additionally and to output the compensated value to the backlight driver.

As mentioned above, the local dimming method and device according to the present invention may adjust the number of the spatial filtering repetitions based on the halo level. As the number of the spatial filtering repetitions is increased, the halo may be reduced. As the number of the spatial filtering repetitions is decreasing, power consumption may be reduced and the contrast ratio may be improved, compared with the case of the fixed number of the spatial filtering repetitions. In addition, the local dimming method and device according to the present invention may adjust the filter factor of the spatial filter as well as the number of the spatial filtering repetitions. As a result, the local dimming value may be adjusted more minutely.

Figure 6:
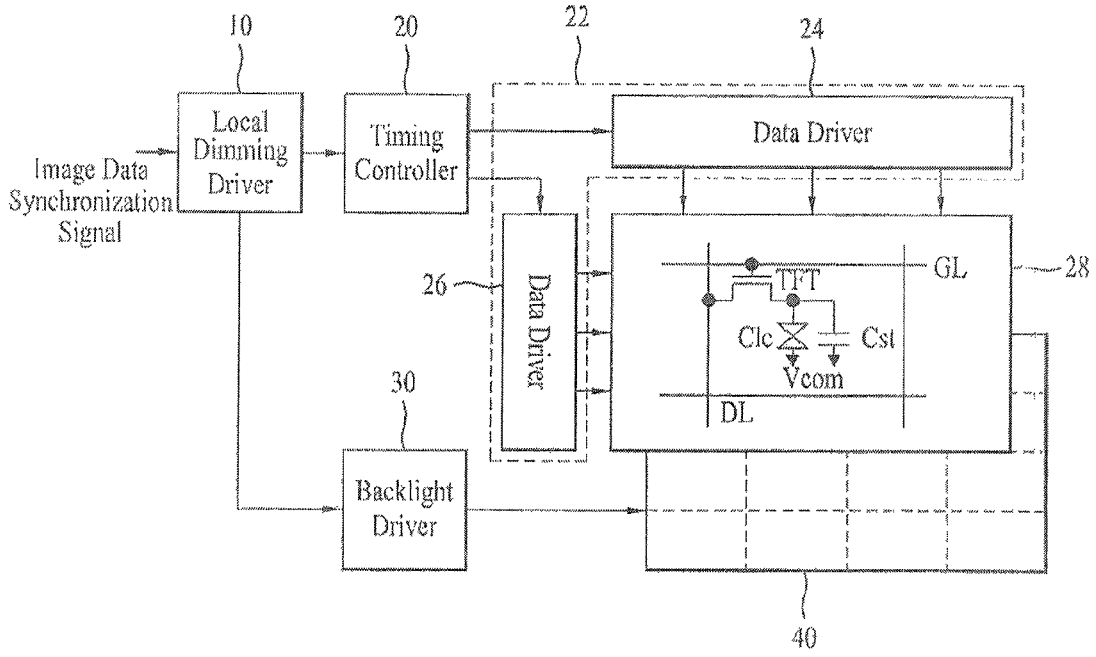
FIG. 6 is a circuit block view schematically illustrating the liquid crystal display device according to the embodiment of the present invention.

FIG. 6 is a diagram schematically illustrating a liquid crystal display device according to an embodiment of the present invention, with the local dimming driver 10 applied thereto.

The liquid crystal display device shown in FIG. 6 includes the local dimming driver 10 configured to determine a local dimming value by analyzing input image data for each of blocks to compensate data, a timing controller 20 configured to supply the data outputted from the local dimming driver 10 to a panel driver 22 and to control a driving timing of the panel driver 22, a backlight driver 30 configured to drive an LED backlight unit 40 for light-emitting blocks based on the local dimming values of the blocks outputted from the local dimming driver, and a liquid crystal panel 28 driven by a data driver 24 and a gate driver 26 of the panel driver 22. Here, the local dimming driver 10 may be embedded in the timing controller 20.

The local dimming driver 10 analyzes data for the blocks by using input image data and a synchronization signal and it determines the local dimming value for each of the blocks based on the result of the analysis. The local dimming driver 10 analyzes the total quantity of lights reaching black pixels by the frame units as described above, and then it calculates the halo indicator (LH) proportional to the average (DB) of the brightness (total light quantity) differences among the black pixels. After that, the local dimming driver 10 determines the halo level based on the ranges of the halo indicator sizes and it adjusts the number of the spatial filtering repetitions, or the number of the spatial filtering repetitions and the filter factor of the spatial filter based on the determined halo level. The local dimming driver 10 compensates the local dimming values for the blocks by using the number of the spatial filtering repetitions adjusted based on the halo level or the number of the spatial filtering repetitions and the filter factor. The spatial filtering is repeated based on the number of the spatial filtering repetitions increased as the halo level is getting larger or based on the number of the spatial filtering repetitions and the filter factor. Because of that, dimming difference among the light-emitting blocks may be reduced and the halo may be reduced effectively. In contrast, the spatial filtering is repeated based on the number of the spatial filtering repetitions decreased as the halo level is getting smaller or based on the number of the spatial filtering repetitions and the filter factor. Because of that, the local dimming value is prevented from increasing and power consumption may be reduced with increasing the contrast ratio. The local dimming driver 10 re-arranges the local dimming values for the blocks adjusted based on the spatial filtering in a connection order of the light-emitting blocks provided in the LED backlight unit 40, to transmit the re-arranged local dimming values to the backlight driver 30. Also, the local dimming driver 10 calculates the gain value for each pixel based on the local dimming value for each block and it compensates brightness of the input data by multiplying of the input image data to the gain value, to output the compensated brightness to the timing controller 20.

The timing controller 20 arranges the data outputted from the local dimming driver 10 and it outputs the arranged data to the data driver 24. In addition, the timing controller 20 generates a data control signal for controlling a driving timing of the data driver 24 and a gate control signal for controlling a driving timing of the gate driver 26 by using synchronization signals inputted from the local dimming driver 10, in other words, vertical synchronization signals, horizontal synchronization signals, data enable signals and dot clocks, to output the data control signal and the data control signal to the data driver 24 and the gate driver 26, respectively. Here, the timing controller 20 may further include an over driving circuit (not shown) configured to convert data by adding an overshoot value or an undershoot value based on data difference between neighboring frames to improve a response speed of liquid crystal.

The panel driver 22 includes a data driver 24 configured to drive data lines (DL) of the liquid crystal panel 28 and a gate driver 26 configured to drive gate lines (GL) of the liquid crystal panel 28.

The data drier 24 converts digital image data transmitted from the timing controller into an analog data signal (pixel voltage signal) by using a gamma voltage, in response to the data control signal transmitted from the timing controller 20 and it transmits the converted analog data signal to the data lines (DL).

The gate driver 26 sequentially drives the gate lines (GL) of the liquid crystal panel 28 in response to the gate control signal transmitted from the timing controller 20.

The liquid crystal panel 28 displays an image via a pixel matrix having pixels arranged thereon. Each of the pixels presents a desired color by using combination of red, green and blue sub-pixels capable of adjusting light tranasmissivity based on variation of liquid crystal arrangement according to the brightness compensated data signal. Each of the sub-pixels includes a thin film transistor (TFT) connected with gate lines (GL) and data lines (DL), a liquid crystal capacitor (Clc) connected with the thin film transistor (TFT) in parallel and a storage capacitor (Cst). The liquid crystal capacitor (Clc) charges a difference voltage between a data signal supplied to a pixel electrode via the thin film transistor (TFT) and a common voltage (Vcom) supplied to the common electrode, and it drives liquid crystal based on the charged voltage to adjust light transmissivity. The storage capacitor (Cst) keeps the voltage charged by the liquid crystal capacitor (Clc) stably.

The backlight unit 40 uses an underneath type or edge type LED backlight and it is divided to be driven into the plurality of the blocks by the backlight driver 30, to project lights to the liquid crystal panel 28. An LED array is opposed to the liquid crystal panel 28 in the underneath type LED backlight to be arranged in an overall display area. An LED array is arranged to be opposed to at least two edges of a light guide plate opposed to the liquid crystal panel 28 and lights projected from the LED array are converted into surface light sources via the light guide plate, such that the converted surface light sources may be emitted to the liquid crystal panel 28.

The backlight driver 30 drives the LED backlight 40 for each of the blocks based on the local dimming value for each of the blocks transmitted from the local dimming driver 10 and it adjusts brightness of the LED backlight 40 for each of the blocks. When the LED backlight 40 divided into to a plurality of ports is selectively driven, a plurality of backlight drivers 30 may be provided to drive the plurality of the ports independently. The backlight driver 30 generates a pulse wide modulation (PWM) signal for each of the blocks, which has a duty ratio corresponding to the local dimming value and it supplies an LED driving signal corresponding to the generated PWM signal for each of the blocks, to drive the LED backlight 40 for each of the blocks. The backlight driver 30 sequentially drives the light-emitting blocks based on the local dimming values inputted from the local dimming driver 10 in the block connection order, to control backlight brightness for each block.

As a result, the liquid crystal display device according to the present invention may display the input image data gained from multiplying of the backlight brightness controlled for each block to the light transmissivity controlled based on the compensated data by the liquid crystal panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A method for local dimming driving a liquid crystal display comprising:

determining a local dimming value for each of a plurality of light-emitting blocks based on analyzing input image data by the unit of light-emitting block provided in a backlight unit;

determining a halo degree by analyzing a total light quantity of black pixels having black gradations in the input image data;

adjusting the number of spatial filtering repetitions based on the determined halo degree;

compensating the local dimming value by performing spatial filtering for the local dimming value an adjusted number of times;

controlling brightness of the backlight unit for each of the blocks by using the compensated local dimming value;

calculating a gain value for each of the blocks by using the total quantity of lights reaching each of the pixels from each of the blocks of the backlight unit and by using the local dimming value for each of the blocks; and compensating the input image data by using the gain value;

wherein the determining of the halo degree comprises;

selecting the black pixels from an input image, selecting a total light quantity for the selected black pixels from the total light quantities for the pixels and storing the total light quantity by at least frame units, calculating an average of the total light quantities for the black pixels by the frame units and a halo indicator representing the halo level in proportion to the average, and determining a halo level based on a range of the halo indicator sizes.

2. The method of local dimming driving the liquid crystal display of claim 1, wherein the average of the total light quantity differences among the black pixels is calculated by dividing an added value by the number of the black pixels after adding an average of the total light quantities of the black pixels to differences among the total light quantities of the black pixels.

3. The method of local dimming driving the liquid crystal display of claim 1, wherein the halo level determining compares a halo indicator of a the present frame with a halo indicator of a former frame, and the halo level determining determines the halo level by using the halo indicator of the former frame as the halo indicator of the present frame, when a difference between the halo indicators of the present frame and the former frame is within a preset threshold value.

4. The method of local dimming driving the liquid crystal display of claim 3, wherein a first threshold value preset when the halo indicator of the present frame is larger than the halo indicator of the former frame is set different from a second threshold value preset when the halo indicator of the present frame is smaller than the halo indicator of the former frame.

5. The method of local dimming driving the liquid crystal display of claim 1, wherein the number of the spatial filtering repetitions is increasing as the determined halo level is getting larger and the number of the spatial filtering repetitions is decreasing as the determined halo level is getting smaller.

6. The method of local dimming driving the liquid crystal display of claim 5, further comprising:

adjusting a filter factor of the spatial filtering based on the halo level.

7. The method of local dimming driving the liquid crystal display of claim 6, wherein the filter factor is increasing as the determined halo level is getting larger and the filter factor is decreasing as the halo level is getting smaller.

8. A liquid crystal display device comprising:

a liquid crystal panel;

a backlight unit divided to be driven separately into a plurality of light-emitting blocks to transmit light to the liquid crystal panel;

a local dimming driver configured to determine a local dimming value for each of the blocks by analyzing input image data for each of the light-emitting blocks and to compensate the input image data by using the local dimming value for each of the blocks; configured to determine a halo degree by analyzing a total light quantity of black pixels having black gradations in the input image data; configured to adjust the number of spatial filtering repetitions based on the determined halo degree; configured to compensate the local dimming value by performing spatial filtering for the local dimming value an adjusted number of times; and configured to control brightness of the backlight unit for each of the blocks by using the compensated local dimming value;

a backlight driver configured to drive the backlight unit for each of the light-emitting blocks by using the local dimming value outputted from the local dimming driver; and a panel driver configured to drive the liquid crystal panel by using the compensated image data;

wherein the local dimming driver comprises;

an image analyzer configured to detect an average of maximum values for each of pixels by analyzing the input image data by the light-emitting block units, a dimming value determiner configured to determine a local dimming value for each of the blocks by using the average of the blocks transmitted from the image analyzer, a data compensator configured to calculate a gain value for each of pixels by using a total quantity of lights reaching each of the pixels from each of the light-emittinq blocks and the local dimming value for each of the blocks determined by the dimming value determiner, and configured to compensate the input image data by using the calculated gain value, a pixel selector configured to select black pixels from the input image data, a total light quantity selector configured to select a total light quantity for each of the black pixels selected by the pixel selector out of the total light quantities of the data compensator and configured to store the selected total light quantity by at least frame units, a halo determiner configured to calculate an average of the total light quantities of the black pixels by using the total light quantities of the black pixels stored by the frame units, configured to calculate a halo indicator presenting a halo degree, which is proportional to the average, and configured to determine a halo level based on a range of sizes of the halo indicator, a filter property adjuster configured to adjust the number of the spatial filtering repetitions based on the halo level determined by the halo determiner, and a spatial filter configured to compensate the local dimming value by performing spatial filtering for the local dimming value a predetermined number of times which is adjusted by the filter property adjustor and configured to compensate the local dimming value.

9. The liquid crystal display device of claim 8, wherein the halo determiner calculates the average of the total light quantity differences among the black pixels by and by dividing an added value by the number of the black pixels after adding an average of the total light quantities of the black pixels to differences among the total light quantities of the black pixels.

10. The liquid crystal display device of claim 8, wherein the halo determiner compares a halo indicator of the present frame with a halo indicator of the former frame, and the halo level determining determines the halo level by using the halo indicator of the former frame as the halo indicator of the present frame, when a difference between the halo indicators of the present frame and the former frame is within a preset threshold value.

11. The liquid crystal display device of claim 10, wherein a first threshold value preset when the halo indicator of the present frame is larger than the halo indicator of the former frame is set different from a second threshold value preset when the halo indicator of the present frame is smaller than the halo indicator of the former frame.

12. The liquid crystal display of claim 8, wherein the number of the spatial filtering repetitions is increasing as the determined halo level is getting larger and the number of the spatial filtering repetitions is decreasing as the determined halo level is getting smaller.

13. The liquid crystal display of claim 8, wherein the filter property adjuster further adjusts a filter factor of the spatial filtering based on the halo level.

14. The liquid crystal display of claim 13, wherein the filter factor is increasing as the determined halo level is getting larger and the filter factor is decreasing as the halo level is getting smaller.

15. The liquid crystal display of claim 8, wherein the local dimming driver comprises, a time filter configured to level an average for each of the blocks transmitted from the image analyzer for a plurality of frames to output the leveled average to the dimming value determiner.

16. The liquid crystal display of claim 8, wherein the local dimming driver further comprises, a multiplier configured to multiply the local dimming value outputted from the spatial filter to a global dimming value set from an outside to output the calculated value to the backlight driver.

* * * * *